US005938995A

United States Patent [19]

Koltisko, Jr. et al.

[11] Patent Number: 5,938,995

[45] Date of Patent: Aug. 17, 1999

[54] COMPRESSION RESISTANT CELLULOSIC-BASED FABRICS HAVING HIGH RATES OF ABSORBENCY

[75] Inventors: Bernard Michael Koltisko, Jr.; Kambiz Bayat Makoui, both of Allentown, Pa.

[73] Assignee: Air Products and Chemicals, Inc., Allentown, Pa.

[21] Appl. No.: 09/019,634

[22] Filed: Feb. 6, 1998

[51] Int. Cl.[6] ..... D04H 1/64; A01N 25/34; D06M 13/322; B27N 3/00

[52] U.S. Cl. ..... 264/128; 424/402; 8/195; 156/62.2

[58] Field of Search ..... 8/120, 116.4, 185, 8/195; 162/9, 157.6, 62.2; 264/128, 121; 156/62.2; 442/149; 424/402

[56] References Cited

U.S. PATENT DOCUMENTS

| | | | |
|---|---|---|---|
| 4,481,250 | 11/1984 | Cook et al. | 442/149 |
| 5,104,923 | 4/1992 | Steinwand et al. | 524/461 |
| 5,137,537 | 8/1992 | Herron et al. | 8/120 |
| 5,190,563 | 3/1993 | Herron et al. | 8/120 |
| 5,256,417 | 10/1993 | Koltisko | 424/402 |
| 5,360,420 | 11/1994 | Cook et al. | 604/378 |
| 5,387,208 | 2/1995 | Ashton et al. | 604/378 |
| 5,401,267 | 3/1995 | Couture-Dorschner | 604/384 |
| 5,460,622 | 10/1995 | Dragoo et al. | 604/378 |
| 5,522,810 | 6/1996 | Allen, Jr. et al. | 604/366 |
| 5,589,256 | 12/1996 | Hansen et al. | 8/120 |
| 5,789,326 | 8/1998 | Hansen et al. | 8/120 |

*Primary Examiner*—Kery Fries
*Assistant Examiner*—Brian Mruk
*Attorney, Agent, or Firm*—Russell L. Brewer

[57] ABSTRACT

A low density compression resistant cellulosic-based nonwoven fabric having good absorbency and et tensile strength is formed from cellulosic-based fibers which are treated for use in an air laid process, with an aqueous dispersion of a self-crosslinkable polymeric binder and a chemical stiffening agent for the cellulose fibers and then dried at temperatures that result in intrafiber crosslinking and interfiber binding. The cellulosic-based nonwoven fabrics, thus formed, are useful in personal care products such as diapers and feminine care products.

17 Claims, No Drawings

COMPRESSION RESISTANT CELLULOSIC-BASED FABRICS HAVING HIGH RATES OF ABSORBENCY

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This invention is directed to a process for producing cellulosic-based air-laid, non-woven fabrics which are suited for use in personal care absorbent products.

BACKGROUND OF THE INVENTION

Personal care absorbent products, such as diapers, and feminine hygiene products and the like are designed to absorb body fluids. These personal care absorbent products are designed so that they transport body fluids away from the wearer of the personal care product to an absorbent core within the absorbent product and, in addition, prevent the transfer of fluids from the absorbent core back to and in contact with the wearer. To accommodate these functions, a multi-layered personal care absorbent products has been developed which is comprised of a soft, body compatible, pervious top sheet, typically a hydrophobic film, an impervious bottom sheet for retaining the body fluids within the personal care product and an absorbent core disposed between the top sheet and the bottom sheet for retaining the fluids. Fluids are transferred through the top sheet to the absorbent core where the fluids are stored until disposal of the personal care product. The impervious bottom sheet prevents the fluids stored in the absorbent core to be transferred to external surfaces.

To enhance the rate of transfer of fluid away from the wearer to the absorbent core, it has also been common practice to bond a thin, low density, cellulosic webbing to the under side of the top sheet (sometimes referred to as an acquisition/distribution layer or transfer layer) and also bond it to the absorbent core. The acquisition/distribution can be characterized as a thin, low density cellulosic web having large pore diameters. The absorbent core is designed for enhanced fluid capacity at the site of wetting with a secondary function of transporting fluid to remote areas of the absorbent core to accommodate multiple discharges of fluid. It can be characterized as a relatively thick, higher density cellulosic webbing having smaller pore diameters than the acquisition/distribution layer. Hence, it is not very effective at quickly channeling liquid away from the wearer to remote of parts therein.

Cellulosic fibers have been widely used as a component in both the acquisition/distribution layer and absorbent cores. Webs formed from untreated cellulosic fibers tend to collapse when wet thus forming a web of higher density and smaller average pore size. Webs formed from untreated cellulosic fibers also have a tendency to gather into cellulosic clumps or discrete sections. Thus, not only is the rate of fluid transfer in an acquisition/distribution layer decreased by the collapse of the untreated cellulosic fiber but also the ability of the absorbent core to transfer fluids to remote portions of the layer. To combat wet collapse of the cellulosic fibers, or alternatively to enhance compression resistance of the cellulosic fiber, it has been common practice to chemically stiffen the cellulosic fibers by treating the cellulosic fibers with chemical stiffening agents. The resulting chemically stiffened cellulosic fibers tend to act like "springs." Under pressure they resist compression and when the pressure is released these "cellulosic springs" cause the web to return to its approximate original thickness. Improved compression resistance has been found to enhance both fluid transfer and absorption.

To improve web strength formed from cellulosic fibers, it has also been common practice to incorporate crosslinkable polymeric binders to webs designed for use in acquisition/distribution layers and absorbent cores for the purpose of providing enhanced wet tensile strength. Thus, the resulting web tends to prevent clumping of the cellulosic fibers and prevent the web from undergoing separation under tension.

The following patents are provided to provide a description of wide variety of personal care absorbent product, their construction and their methods for enhancing fluid transfer and fluid retention within the personal care product.

U.S. Pat. No. 5,360,420 is representative of several patents which disclose absorbent structures incorporating chemically stiffened cellulosic fibers. Such chemically stiffened cellulosic fibers are incorporated into acquisition/distribution layers having an average dry density of about 0.3 grams/cc. More particularly, the webs are comprised of from 50% to 100% of chemically stiffened cellulosic fibers and from 0 to about 50% of a binding means for increasing physical integrity of the web, to facilitate processing and to improve end-use performance. The storage layer is comprised from about 15% by weight of a super-absorbent material and 0 to 85% of a carrier for the super-absorbent and comprised of synthetic or natural fibers. Typically cellulose fibers in the form of fluff, which include chemically stiffened cellulosic fibers, are incorporated into the web. Processing methods which can be used to form the acquisition/distribution layer and the storage layer include air-laid and wet-laid techniques.

U.S. Pat. No. 5,401,267 discloses absorbent articles which exhibit an enhanced wicking capacity. The absorbent article includes a liquid-permeable cover, liquid impermeable baffle and an absorbent. The absorbent is constructed of first, second and third members with the wicking capacity of both the first and third members being greater than the wicking capacity of the second member. The first member is described as a perforated cover sheet, and the second member is comprised of hydrophilic materials such as cellulose fibers and hydrophilic polyethylene polypropylene in an air-formed blend. The third member is typically comprised of tissue layers or cellulosic fluff.

U.S. Pat. No. 5,387,208 discloses an absorbent core for use in personal care products having improved dry-wet integrity. The absorbent core is comprised of an absorbent means such a crepe cellulose wadding, melt-blown polymers including coform; chemically stiffened, modified or crosslinked cellulosic fibers, and the like. The absorbent core may also have caliper-zones, hydrophilic gradients and also incorporate super absorbent gelling materials.

U.S. Pat. No. 5,137,537 discloses absorbent structures for use in personal care products containing individualized, cross-linked fibers. The cross-linked fibers are described as being useful for producing lower-density absorbent products. A wide variety of chemical cross-linking agents are suggested for curing the individualized cross-linked fibers and these include aliphatic and alicyclic $C_2$–$C_9$ polycarboxylic acids, glyoxal and so forth.

U.S. Pat. No. 5,460,622 discloses absorbent articles such diapers, sanitary napkins, adult incontinence devices and the like. The absorbent articles are comprised of blends of different types of fibers for providing improved integrity and liquid processing capabilities. More particularly, the absorbent core comprises a blend of cellulosic fibers, absorbent gelling material and crimped synthetic fibers, the function of the crimped synthetic fibers being to improve integrity, acquisition rate, absorbent capacity and resilience of the acquisition layer. The synthetic fibers are described as crimped polyester fibers which are not affected by the presence of moisture and therefore, do not collapse as do cellulosic fibers when wet.

U.S. Pat. No. 5,522,810 discloses a compression resistant and resilient nonwoven web made up of randomly-deposited fibers bonded to one another by one or more bonding methods, such as air laying, spunbonding, and bonded carded web formation. In order to obtain a compression resistant web, at least a portion of the fibers forming the web should be made from polymers which are heat bondable such as polyolefins, polyesters, polyamides, and polyvinyl alcohol. The resultant product is typically used as a top sheet or as a separation layer in personal care absorbent products.

U.S. Pat. No. 5,190,563 discloses a process for making individualized, crosslinked fibers by contacting the fibers with a solution containing a $C_2$–$C_9$ polycarboxylic acid, such as citric acid, separating the fibers into individual form, drying the fibers, and then reacting the crosslinking agent with the fibers to form intrafiber crosslink bonds. The product is reported to exhibit improved absorbency and increased wet resilience compared to absorbent cores made from conventional, uncrosslinked fibers or prior known crosslinked fibers.

U.S. Pat. No. 5,104,923 discloses the combination of a crosslinkable binder and a polycarboxylate catalyst for imparting high wet strength to nonwoven cellulosic materials. The binder is formed from an aqueous emulsion polymer such as styrene-butadiene-itaconic acid copolymer. Representative nonpolymerizable catalysts include sodium ethylene diamine tetraacetate, citric acid and oxalic acid it can be incorporated in an amount of from 0.1 to 3%.

SUMMARY OF THE INVENTION

This invention is directed to an improved process for producing cellulosic-based air-laid nonwoven fabrics having excellent compression resistance and resiliency together with good absorbency and tensile strength. The air-laid nonwoven fabrics are suitable for a number of uses including, but not limited to, the formation of transport layers and absorbent cores employed in personal care absorbent products. The basic process for producing low density (~0.02 to ~0.9, generally 0.03 to 0.5 grams/cc and having a thickness of from 0.5 to 4mm) air-laid nonwoven fabrics comprises randomly distributing a layer of cellulosic fibers onto a moving perforated belt thereby forming a web of cellulosic fibers, applying an aqueous emulsion containing a polymeric binder to the web of cellulosic fibers and subsequently drying the web of the cellulosic fibers to form said air-laid web. The improvement in the process for forming the air-laid web comprises:

stiffening the fibers by applying an aqueous medium containing a chemical stiffening agent to the fibers, said chemical stiffening agent being capable of effecting cross-linking of the cellulosic fibers in the air-laid web; and subsequently, effecting drying of the cellulosic fibers under conditions sufficient for removing water and effecting reaction between the chemical stiffening agent and cellulosic fibers thereby imparting stiffening thereto.

The aqueous medium containing the chemical stiffening agent is applied either (a) to the air-laid web simultaneously with the aqueous emulsion containing the polymeric binder, or, (b) prior to applying the aqueous emulsion containing the polymeric binder and prior to effecting reaction between the chemical stiffening agent and cellulosic fibers for imparting stiffening thereto.

There are several advantages to the process of this invention and these include:

- an ability to achieve compression resistance in a cellulosic based air-laid web while retaining dry strength and/or wet strength;
- an ability to form low density air-laid webs having the above properties employing a single drying step;
- an ability to easily effect bonding of the acquisition/distribution layer to the cover sheet and to the absorbent core;
- an ability to form low density, air-laid webs comprised of chemically softened fibers of relatively uniform thickness; and,
- an ability to minimize handling and processing problems commonly associated with the chemically stiffened cellulosic fibers particularly when used in forming air-laid webs.

DETAILED DESCRIPTION OF THE INVENTION

It has been found that air-laid nonwoven webs suitable for personal care products which are comprised of chemically stiffened cellulosic fibers can be formed without undergoing the conventional route of first forming the chemically stiffened fibers prior to forming the air-laid web and bonding with a polymeric binder. The improved process described herein eliminates many of the problems associated with the prior art processes for producing low density, compression resistant and resilient cellulosic-based nonwoven air-laid webs having good absorbency and wet tensile strength. The process differs from the prior art in that the process steps result in incorporating the chemical stiffening agent into the cellulose fibers or into the air-laid web comprised of cellulosic fibers prior to effecting crosslinking with the chemical stiffening agent.

The low density nonwoven webs described herein are formed by an air-laid process. A typical air laying system consists of four zones: a defiberizing zone, a forming zone, a bonding/drying zone, and a rewinding zone or finishing zone. In the defiberizing zone, the raw material (e.g., bleached Kraft fiber) is fed into a hammer mill unit to separate the fibers and make fluff. The fluff is then transferred, by the aid of a transport fan, to distributor units in the forming section. In the forming section, the fluff is distributed over a forming belt which is under vacuum, to make the air-laid web. The web is then conveyed under a set of compactor rolls to improve its uniformity and increase its density, before it is transferred to the bonding/drying zone. In the bonding/drying zone, the web is sprayed with a latex containing polymeric binder and then transferred to an oven. The dried web is wound into a roll for shipment. In the prior art where the cellulosic fibers were crosslinked with a chemical stiffening agent prior to forming the web there was difficulty in consistently obtaining uniform thickness of the web because of the webs resistance to compression under pressure. Also, the fiberized "springs" tend to cause problems because of entanglement via the formation of fiber bundles, fiber knots, fiber balls. These entanglements are difficult to separate and cause jamming in the distribution zone.

In this process, cellulosic-based fibers are employed in forming the air-laid web and by that it is meant to refer to fibers containing predominantly $C_6H_{10}O_5$ groupings. Examples include natural cellulose fibers derived from wood pulp, cotton and hemp. Artificial fibers such as cellulose acetate; synthetic fibers such as polyamides, nylon, polyesters, acrylics, polyolefins, e.g., polyethylene, polyvinyl chloride, polyurethane, and the like, alone or in combination with one another may be incorporated with the cellulose based fibers to form the web, typically in an amount not exceeding 50% by weight and preferably not exceeding 25% by weight. Therefore, the term "cellulosic fibers" is also intended to include other fibers commingled with the cellulosic fibers.

The chemical stiffening agents employed in the manufacture of crosslinked cellulosic fibers include those which have been used in the past. Suitable crosslinkers include $C_2$ to $C_9$ aliphatic, alicyclic and aromatic polycarboxylic acids which preferably contain three or more carboxyl groups per molecule and are either saturated or unsaturated. Examples of appropriate acids include citric acid; 1,2,3,4-butane tetracarboxylic acid (BTCA); 1,2,3-propane tricarboxylic acid; 1,2,3,4-cyclopentane tetracarboxylic acid; and, benzene hexacarboxylic acid. Of these acids BTCA is preferred. Other effective crosslinkers include $C_{2-8}$ dialdehydes, $C_{2-8}$ monoaldehydes and the like. Examples include glutaraldehyde, glyoxal, and glyoxylic acid. N-methylol compounds such as dimethylol ethylene urea or dimethylol dihydroxy ethylene urea can also be used. Dimethylol dihydroxy ethylene urea (DMDHEU) and glyoxal are the most preferred crosslinkers because these crosslinkers react well at low temperatures. Polycarboxylic acids require higher reaction temperatures and the use of a catalyst. Sometimes when using polycarboxylic acids, crosslinking may be insufficient to obtain desired chemical stiffening. Further examples and their use in forming chemically stiffened fibers are found in U.S. Pat. No. 5,360,420 and are incorporated by reference.

The polymeric binder and chemical stiffening agent are applied in conventional amounts. For the chemical stiffening agent the crosslinked fibers are reacted with the crosslinking agent in an amount of from 0.5 to 10 mole %, preferably from 1% to 5 mole % calculated on a cellulose anhydroglucose molar basis. Alternatively the crosslinking agent is applied on a weight basis. For ease generally from 50 to 95 dry weight parts polymeric binder and 5 to 50 dry weight parts crosslinker, preferably about 65 to 85 dry weight parts polymeric binder to 15 to 35 dry weight parts crosslinker, all on a basis of 100 total dry weight parts binder and crosslinker are employed.

To obtain integrity and particular, wet strength, which helps to improve machinability, polymeric binders are employed in the manufacture of such air-laid webs. Polymeric binders with low glass transition temperatures (less than about 40° C.) are especially useful in providing soft hand or feel. Crosslinkable polymeric binders are used to provide wet strength to the air-laid webs. The latter binders may be heat fused or heat cured at elevated temperatures. Suitable binders, both crosslinkable and noncrosslinkable, include polymeric materials in the form of aqueous emulsions or solutions or non-aqueous solutions. Appropriate binders include emulsion or solution polymers having a Tg of −20 to +40° C., preferably from −15 to 10° C. Some examples of polymeric binders include ethylene-vinyl alcohol; polyvinyl acetate, acrylic, polyvinyl acetate acrylate, acrylates, vinyl acetate/ethylene, ethylene-vinyl chloride, polyvinyl chloride, styrene, styrene acrylate, styrene-butadiene, styrene-acrylonitrile, butadiene-acrylonitrile, ethylene-acrylic acid, and polyethylene. Self-crosslinkable polymers typically are based upon from formaldehyde emitters such as the N-methylol acrylamide and N-methylolacrylamide/acrylamide derivatives which crosslinking components are incorporated into the polymer in an amount of from 1 to 4% by weight of the polymer. Other crosslinkers are often based upon amine functionality. Vinyl acetate/ethylene/N-methylolacylamide emulsion copolymers of the preferred Tg (−15 to +10° C.) and sold under the trademark Airflex® with Air Products and Chemicals, Inc. are preferred.

High temperature reactions can be avoided by using a catalyst for the reaction of the chemical stiffening agent and cellulose and to effect crosslinking of the polymeric binder should a crosslinking agent be incorporated into the polymer. Typical catalysts are alkali metal salts of phosphorus-containing acids such as alkali metal hypophosphites, alkali metal phosphates, and alkali metal phosphates. Examples of other catalysts are: sodium hypophosphite, disodium phosphate, and sodium phosphate. Carbodiimides can also be used as catalysts; for example, cyanamide, dicyandiamide, and disodium cyanamide. Alkali metal hypophosphites are preferred, especially sodium hypophosphite. Ammonium chloride is a suited catalyst for effecting crosslinking of the N-methylol derivatives employed in polymeric binders. Compression resistance is used as a measure of resilience or the ability of the cellulosic fibers to return toward an expanded original state after release of a compression force.

Although not required, a small amount of surfactant, i.e., 0.5 to 1.5% by weight, based on the weight of binder, may be incorporated into aqueous mixtures of polymeric binder, polycarboxylic acid and catalyst. Example of appropriate surfactants include sulfosuccinates, ethoxylated alkyl phenols, and acetylenic diols.

To obtain the improved air-laid nonwoven cellulosic-based fabric of this invention, an aqueous dispersion of a polymeric binder and chemically stiffening agent are applied to an air-laid web of cellulosic fibers simultaneously or sequentially. The key is to apply the chemical stiffening agent to the fibers prior to forming the web or to the web itself prior to or simultaneously with the polymeric binder. The binder is applied to the web of cellulosic fibers prior to effecting crosslinking of the chemical stiffening agent with the cellulosic fibers. If the binder is applied prior to the chemical stiffening agent, the compression resistance of the air-laid may be lessened as compared to the compression resistance of the air-laid web where the chemical stiffening agent is applied prior to the binder or simultaneously therewith. If the chemical stiffening agent is applied to the fibers and crosslinked prior to web formation, then one experiences entanglement problems as mentioned, supra. However, the chemical stiffening agent solution may be applied to the fibers and the fibers dried under non crosslinking conditions then formed into the web for further processing.

For ease of processing the web by an air-laid process the cellulosic-based fibers are contacted with an aqueous dispersion comprised of the polymeric binder having a Tg of about −20 to +40° C., preferably −15 to +10° C., the chemical stiffening agent (crosslinker), and optionally the catalyst. Typically the dispersion has a solids content comprised of polymeric binder in amount of from 60 to 95% by weight, the crosslinker from 5 to 40% by weight, and the catalyst typically from 0.5 to 8% by weight, based on the total weight of solids in the binder, crosslinker, and catalyst. If contacting is effected via spray apparatus, then the dispersion may have to be diluted with water. The add-on level of the solids material from the dispersion(s) should be from about 10 to 30%, preferably 15 to 25% by weight based upon the weight of the fibers in the air-laid web.

Standard high-temperature drying and curing ovens are used to bind and crosslink the fibers. Conventional temperatures for curing and crosslinking range from 300° F. (149° C.) to 400° F. (204° C.). Typically one can achieve complete curing at a temperature of up to 320° F. (160° C.). Substantially higher temperatures are avoided for reasons that such temperatures may result in discoloration and other problems. The inability to utilize high temperatures is one of the reasons that chemical stiffening agents such as the dialdehydes and ureas are employed in contrast to the polycarboxylic acids.

The combination of binder, chemical stiffening agent (crosslinker), and catalyst are applied in one operation as a single aqueous dispersion. The saturated fibers are then heated to a temperature that results in not only drying of the web but also to a temperature for effecting crosslinking of the chemical stiffening agent with the cellulosic fibers. The resulting product can be formed into sheets or rolled for convenient shipping and processing. This combination of polymeric binder, crosslinker, and catalyst, when applied in a single operation or sequentially as described unexpectedly enhances compression resistance, rate of absorption, and fluid capacity of the fabric while maintaining tensile properties.

The invention will be further clarified by a consideration of the following examples, which are intended to be exemplary of the invention.

EXAMPLE 1

Simultaneous Spray With Binder and Chemical Stiffening Agent

A standard grade of paper towel (Boun having a relatively uniform thickness was sprayed with various formulations consisting of about 50% total solids by weight and incorporating the components described in Table 1 (on a solids basis) and then evaluated for compression resistance (a parameter indicative of the wicking rate of the web) and absorbency. More particularly, the samples were coated and the coated samples then cured for 7 minutes at 320° F. (160° C.) in a Mathis oven, followed by equilibration at 72° F. (22° C.) at 50% relative humidity for 24 hours. A control sample (Run 1) was sprayed with distilled water and handled in the same fashion as the coated samples.

Test Method For Compression Resistance

The coated samples were dipped in distilled water, lightly blotted, and folded. Then they were placed in a static thickness tester and 6.5 psi of pressure was applied. Sample thickness was measured as a function of time. Compression resistance is a measure of the web to collapse under pressure.

Measurement of Absorbency

Absorbency of 0.9% saline into the fabric was measured using a gravimetric absorbency tester (model by M/K Systems) with a diffuse fluid source. Fluid capacity was measured under no compressive force and at 0.15 psi compressive force. Absorbency is expressed as grams of fluid absorbed per gram of fabric under those conditions.

TABLE 1

| Run | Coating Formulation* | Dry parts | % Add-on | Thickness, mils (1 min., 6.5 psi) | Thickness, mils (5 min., 6.5 psi) | Saline Capacity, g/g (0 psi) | Saline Capacity, g/g (0.15 psi) |
|---|---|---|---|---|---|---|---|
| 1 | Uncoated | — | — | 22.0 | 21.7 | 13.3 | 8.5 |
| 2 | A-124 | 99 | | | | | |
| | $NH_4Cl$ | 1 | 23.7 | 25.6 | 24.6 | 14.0 | 8.8 |
| 3 | A-124 | 80 | | | | | |
| | BTCA | 17.2 | 22.5 | 32.9 | 31.8 | 16.8 | 12.9 |
| | SHP | 2.8 | | | | | |
| 4 | A-124 | 60 | | | | | |
| | BTCA | 34.3 | 20.7 | 39.9 | 38.3 | | |
| | SHP | 5.7 | | | | | |
| 5 | A-124 | 40 | | | | | |
| | BTCA | 51.4 | 22.8 | 51.7 | 49.2 | | |
| | SHP | 8.6 | | | | | |
| 6 | A-124 | 20 | | | | | |
| | BTCA | 68.6 | 17.4 | 50.0 | 48.1 | | |
| | SHP | 11.4 | | | | | |
| 7 | A-124 | 0 | | | | | |
| | BTCA | 85.7 | 15.6 | 45.9 | 44.8 | 15.3 | 13.5 |
| | SHP | 14.3 | | | | | |

*A-124: Airflex ® 124 vinyl acetate/ethylene/N-methylolacrylamide emulsion copolymer (Tg = −15° C.); manufactured by Air Products and Chemicals, Inc. is a crosslinkable polymer.
$NH_4Cl$: ammonium chloride catalyst
BTCA: 1,2,3,4-butane tetracarboxylic acid
SHP: sodium hypophosphite catalyst, reagent grade The molar ratio of BTCA to SHP was about 6:1 in Runs 3–7.

Surprisingly, the results in Table 1 show that it is possible to achieve a high degree of compression resistance by the simultaneous application of polymeric binder and chemical stiffening agent to an air-laid web followed by drying of the web and curing of the crosslinker. This fact in Table 1 is borne out by the showing of enhanced thickness of the Bounty towel which was caused by the chemical stiffening of the cellulosic fibers in the paper towel. For example, runs 3–6 show an increase in thickness of the Bounty towel as compared to the thickness of the non-chemically stiffened fibers in Bounty towel in Runs 1 and 2. Further the thickness of the towel remained relatively constant under pressure thus showing a resistance to collapse. The runs, 3–7, verses runs 1 and 2 also show that the increased thickness of the web due to the chemical stiffening of the fibers added to the saline capacity of the web.

EXAMPLE 2

Wet Compression Resistance and Recovery

The procedure of Example 1 was repeated and the air-laid webs tested for wet compression resistance and recovery as well as for tensile strength.

Wet compression resistance and recovery were measured on 4 inch by 6 inch coated fabric samples soaked in distilled water. Samples were removed from the water, excess water was allowed to drip off, and the samples were gently blotted. The samples were then folded and placed in a static thickness tester. A first load of 0.1 psi was applied to the samples and the thickness measured after 1 minute. The applied load then was increased to 1.1 psi and the thickness measured after 1 minute. In the measure of recovery, the load then was decreased to 0.1 psi and the thickness measured after 1 minute. These one minute procedures were repeated for 2.2 and 6.5 psi loads.

Tensile properties were measured using an Instron Tensile Tester. Strips, 1 inch wide with a gauge length of 2 inches, were cut from the coated fabrics. The crosshead speed was 1 inch per minute. Wet strength was measured by soaking the strips in water for 1 minute prior to testing. Six specimens were measured per condition and an average value reported.

Compression resistance and recovery is presented in Table 2 and tensile properties are set forth in Table 3.

TABLE 2

| Run | Coating Formulation* | Dry parts | Add-on, % | Thickness, (mils) 0.1 psi | Thickness (mils) 1.1 psi/recovery | Thickness (mils) 2.2 psi/recovery | Thickness (mils) 6.5 psi/recovery |
|---|---|---|---|---|---|---|---|
| 1 | Uncoated | — | — | 63.0 | 44.3/48.3 | 34.9/43.6 | 28.2/40.1 |
| 2 | A-124 | 99 | 24.1 | 60.7 | 44.3/47.5 | 36.9/43.8 | 25.1/39.0 |
| | $NH_4Cl$ | 1 | | | | | |
| 3 | A-124 | 80 | 23.5 | 76.0 | 56.8/61.9 | 47.8/58.4 | 33.8/54.3 |
| | BTCA | 17.2 | | | | | |
| | SHP | 2.8 | | | | | |
| 4 | A-124 | 60 | 23.6 | 84.7 | 65.5/71.1 | 54.3/67.5 | 37.8/59.0 |
| | BTCA | 34.3 | | | | | |
| | SHP | 5.7 | | | | | |

TABLE 2-continued

| Run | Coating Formulation* | Dry parts | Add-on, % | Thickness, (mils) 0.1 psi | Thickness (mils) 1.1 psi/recovery | Thickness (mils) 2.2 psi/recovery | Thickness (mils) 6.5 psi/recovery |
|---|---|---|---|---|---|---|---|
| 5 | A-124 | 40 | 20.4 | 98.1 | 76.1/79.9 | 61.2/74.7 | 42.5/66.4 |
| | BTCA | 51.4 | | | | | |
| | SHP | 8.6 | | | | | |
| 6 | A-124 | 20 | 19.8 | 99.8 | 67.6/74.3 | 55.9/65.6 | 39.3/59.5 |
| | BTCA | 68.6 | | | | | |
| | SHP | 11.4 | | | | | |
| 7 | BTCA | 85.7 | 20.5 | 85.4 | 60.3/65.5 | 53.4/61.7 | 49.2/59.5 |
| | SHP | 14.3 | | | | | |

*1 part of Aerosol OT (Dioctyl sulfosuccinate, sodium salt - surfactant manufactured by American Cyanamid) was added to the formulations of Run 2 through 7.

These results in Table 2 show chemical stiffening of the fibers by virtue of the greater thickness of the web in comparison to the control (runs 1 and 2). Compression resistance and recovery is also shown as the web when under pressure is maintained at a thickness greater than the thickness of the control webs. Also, the sums show recovery to a higher thickness on release of the load.

TABLE 3

| Run | Formulation | Dry Parts | Add-On, % | Dry Tensile Strength, g | Dry Elongation, % | Wet Tensile Strength, g | Wet Elongation, % |
|---|---|---|---|---|---|---|---|
| 1 | uncoated | — | — | 315 | 19.1 | 153 | 25.2 |
| 2 | A-124 | 99 | 23.7 | 1313 | 20.7 | 765 | 26.7 |
| | $NH_4Cl$ | 1 | | | | | |
| 3 | A-124 | 80 | | | | | |
| | BTCA | 17.2 | 22.8 | 1160 | 13.2 | 801 | 17.6 |
| | SHP | 2.8 | | | | | |
| 4 | A-124 | 60 | | | | | |
| | BTCA | 34.3 | 24.0 | 1016 | 9.7 | 623 | 15.2 |
| | SHP | 5.7 | | | | | |
| 5 | A-124 | 40 | | | | | |
| | BTCA | 51.4 | 21.1 | 718 | 8.7 | 544 | 10.7 |
| | SHP | 8.6 | | | | | |
| 6 | A-124 | 29 | | | | | |
| | BTCA | 68.6 | 21.6 | 580 | 9.3 | 388 | 13.6 |
| | SHP | 11.4 | | | | | |
| 7 | BTCA | 85.7 | 21.2 | 280 | 18.0 | 216 | 22.7 |
| | SHP | 14.3 | | | | | |

*1 part of Aerosol OT surfactant added to the formulations of Runs 2 through 7.

Tensile properties are particularly important in determining how easily air laid fabrics can be processed. Based on experience, dry elongation values below about 10% would not provide sufficient stretch to the fabric for processing without breakage. The data in Table 3 show that the dry elongation was excellent for Runs 3 and 4 but became marginal in Run 5. The dry tensile properties are also of interest in that dry tensile properties below about 1000 g often do not afford sufficient strength for processing. Wet tensile is of interest in some applications and, as shown, there is an ability to achieve both dry and wet tensile by the process. It would appear, then, that both tensile and elongation start to become undesirable when the binder to crosslinker weight ratio fall below about 1:1 as it did in Run 5.

EXAMPLE 3

Compression and Recovery Properties

The same procedure was followed as in Example 2 except that a higher Tg Airflex®108 vinyl acetate/ethylene/N-methylolacrylamide emulsion copolymer was used as the binder, instead of the Airflex 124 emulsion. The results are presented in Table 4.

TABLE 4

| Run | Formulation* | Dry Parts | Add-On, % | Thickness, mils @ 0.1 psi | Thickness, mils at 1.1 psi/recovery | Thickness, mils at 2.2 psi/recovery | Thickness, mils at 6.5 psi/recovery |
|---|---|---|---|---|---|---|---|
| 1 | Uncoated | — | — | 45.7 | 32.5/37.7 | 27.5/31.6 | 20.9/29.9 |
| 2 | A-108 | 100 | 20.5 | 65.4 | 41.5/44.7 | 34.9/42.2 | 26.4/37.6 |
| | $NH_4Cl$ | 1 | | | | | |
| 3 | A-108 | 90 | 23.4 | 69.1 | 52.5/60.1 | 46.1/59.2 | 33.8/54.6 |
| | BTCA | 10 | | | | | |
| | SHP | 3 | | | | | |

*Airflex ® 108 vinyl acetate-ethylene-NMA emulsion copolymer (Tg = −1° C.); manufactured by Air Products and Chemicals, Inc.
1 part of Aerosol OT added to the formulations of Runs 2 and 3.

Table 5 presents resiliency index values for runs 1–3. The resiliency index is calculated as the wet thickness of the sample after recovery from pressure—minus the thickness of the sample under pressure divided by the thickness of the sample after recovery.

TABLE 5

| Run | Formulation* | Dry Parts | Add-On, % | RI 1.1 psi | RI 2.2 psi | RI 6.5 psi |
|---|---|---|---|---|---|---|
| 1 | Uncoated | — | — | 13.8 | 13.0 | 30.1 |
| 2 | A-108 | 100 | 20.5 | 7.2 | 17.3 | 29.6 |
| | $NH_4Cl$ | 1 | | | | |
| 3 | A-108 | 90 | 23.4 | 12.6 | 22.1 | 38.1 |
| | BTCA | 10 | | | | |
| | SHP | 3 | | | | |

The data in Table 5 show that the addition of 10 wt % BTCA crosslinker (Run 3) considerably improves compression resistance compared to Run 1 (untreated) or Run 2 (binder alone). These differences are reflected in the resiliency index of the runs, presented in Table 5. The resiliency index of Run 3 (crosslinker and binder) is significantly higher than Runs 1 (uncoated) and Run 2 (binder alone) at pressures of 2.2 psi and 6.5 psi.

EXAMPLE 5

Comparison of Three Treatment Methods

This example compares three methods for the treatment of cellulosic fibers with crosslinker and binder: Air-laid sheets were formed (density of 0.05 g/cc) and contacted with binder and crosslinker solutions in accordance with the following procedures. Hand sheet sprayers were used to apply the aqueous solutions.

1) spraying fiber web with crosslinker followed by spraying with binder, and then drying;
2) spraying fiber web with crosslinker, drying, spraying with binder, and then drying again;
3) spraying fiber web with a combination of crosslinker and binder in one application and then drying.

Saline capacity, absorption expansion or collapse, resiliency index, and wet and dry tensile strength were measured for each of the samples. The fiber web was 95% virgin, bleached kraft wood pulp and 5% bicomponent (synthetic) fiber. The add-on, based on the dry weight of the fiber in the web, was 20% binder (Airflex ® 192 vinyl acetate-ethylene-NMA emulsion copolymer having a Tg of 10° C.; manufactured by Air Products and Chemicals, Inc.), 7.5% crosslinker (Freerez 900; dimethylol dihydroxyethylene urea; manufactured by Freedom Chemical Co.), and 3% catalyst (Free Cat 9, manufactured by Freedom Chemical Co.).

TABLE 6

| Run | Add-On | Basis Wt. ($g/m^2$) | Thickness (mm) | Wet Bulk (cc/g) | Saline Capacity (g/g) | Absorbency Rate (g/g/s) | RI | Dry Tensile (g/5 cm) | Wet Tensile (g/5 cm) |
|---|---|---|---|---|---|---|---|---|---|
| 1 | 19 | 92 | 7 | 11 | 13 | 0.1 | 34 | 2118 | 1436 |
| 2 | 18 | 105 | 10 | 12 | 15 | 0.1 | 35 | 1651 | 1018 |
| 3 | 19 | 91 | 7 | 10 | 12 | 0.2 | 32 | 1977 | 1343 |
| Control[4] | 18 | 92 | 6 | 9 | 11 | 0.2 | 29 | 2623 | 1408 |

TS = tensile strength
RI = resiliency index
[1]Air-laid web sprayed with crosslinker, followed by spraying with binder, then dried and cured.
[2]Air-laid web sprayed with crosslinker, dried, then sprayed with binder, dried and cured.
[3]Air-laid web sprayed with combination of crosslinker and binder as one solution, dried and cured.
[4]Air-laid web sprayed with binder, dried and cured.

The data presented in Table 6 show that regardless of whether the crosslinker and binder are applied separately, or as a single solution, excellent property results can be achieved. The resiliency index is above 30 and absorbency, as measured by saline capacity, is superior to the control. Even though the numerical values for resiliency index and absorbency appear similar, it is expected as one moves to conventional processing procedures, the differences between the runs and the control would increase. The use of a hand sheet sprayer usually yields lower values.

EXAMPLE 6

A series of air-laid webs (density 0.03 g/cc) were produced in accordance with the procedure of Example 1 with various binders and crosslinkers. Table 7 sets forth the results.

TABLE 7

Resiliency - Air Laid Runs

| Sample | Basis Wt g/m2 | Dry Thick mm | Wet Bulk cc/g | Max Cap g/g | Abs Rate g/g/sec | Res. Index |
|---|---|---|---|---|---|---|
| A | 47.4 | 6.6 | 8.4 | 9.0 | 0.07 | 38 |
| B | 61.3 | 9.0 | 11.3 | 15.9 | 0.03 | 46 |
| C | 64.3 | 9.5 | 11.1 | 11.7 | 0.03 | 45 |
| D | 54.9 | 8.9 | 10.9 | 16.8 | 0.03 | 47 |

A. Airfex 192 binder - no crosslinker.
B. Airflex 192 binder with dimethylol dihydroxyethylene urea.
C. Airflex 192 binder with dimethylol dihydroxyethylene urea and formaldehyde scavenger.
D. Airflex 192 binder with glyoxal crosslinker.

The results show that the air-laid webs B, C & D processed by the simultaneous application of binder and crosslinker, followed by drying and curing resulted in higher wet bulk thickness, capacity, absorption rate and resiliency index.

To summarize, the fabrics treated, using the process of this invention, can be useful in a variety of products; for example, advanced personal care products, such as catamenial, adult incontinence and child diapers, spill control products, such as absorbent mats, protective wrapping materials used to minimize fluid contact and enhance shock resistance, wiping products, protective garments, bandages, and filters. One of its specific uses may be in the place of, for example, wood pulp fibers in the form of "fluff".

What is claimed is:

1. In a process for producing an air-laid nonwoven web designed for use in personal care absorbent products which comprises randomly distributing a layer of cellulosic fibers onto a moving perforated belt thereby forming a web of cellulosic fibers, applying an aqueous emulsion containing a polymeric binder to the web of cellulosic fibers and subsequently drying the web of cellulosic fibers to form said air-laid web, the improvement in the process for forming a high tensile, compression resistant air-laid web which comprises:

stiffening the fibers by applying an aqueous medium containing a chemical stiffening agent to the fibers, said chemical stiffening agent being capable of effecting cross-linking of the cellulosic fibers and subsequently, heating the web of cellulosic fibers under conditions sufficient for removing water from the air-laid web and effecting reaction between the chemical stiffening agent and cellulosic fibers for imparting stiffening thereto, said aqueous medium containing the chemical stiffening agent being applied either:

(a) simultaneously with the aqueous emulsion containing the polymeric binder; or, (b) prior to applying the aqueous emulsion containing the polymeric binder and prior to effecting reaction between the chemical stiffening agent and cellulosic fibers for imparting stiffening thereto.

2. The process of claim 1 wherein the polymeric binder is a self crosslinkable polymeric binder.

3. The process of claim 2 wherein the polymeric binder and chemical stiffening agent are incorporated into the air-laid web in an amount of from 10 to 30% by weight of the cellulosic fibers.

4. The process of claim 3 wherein the polymeric binder and chemical stiffening agent are incorporated in the web in a weight ratio of from 50 to 95 dry weight parts polymeric binder and 5 to 50 dry weight parts chemical stiffening agent per 100 dry weight parts polymeric binder and chemical stiffening agent.

5. The process of claim 4 wherein the polymeric binder and chemical stiffening agent are applied as a single aqueous dispersion.

6. The process of claim 5 wherein the aqueous dispersion is comprised of from 40 to 65% solids.

7. The process of claim 6 wherein the aqueous dispersion is comprised of polymeric binder in amount of from 60 to 95% by weight, and the chemical stiffening agent from 5 to 40% by weight.

8. The process of claim 4 wherein the polymeric binder is an emulsion polymerized self-crosslinkable vinyl acetate-ethylene emulsion polymer.

9. The process of claim 8 wherein the polymeric binder has a Tg of about −20 to +40° C.

10. The process of claim 9 wherein the chemical stiffening agent is selected from the group consisting of citric acid, 1,2,3,4-butanetetracarboxylic acid, 1,2,3-propane tricarboxylic acid, 1,2,3,4-cyclopentane tetracarboxylic acid, benzene hexacarboxylic acid, glyoxal and dimethylol dihydroxyethylene urea.

11. The process of claim 9 wherein the chemical stiffening agent is dimethylol dihydroxyethylene urea or glyoxal.

12. An air laid process for forming a cellulosic-based compression resistant nonwoven fabric having good absorbency and tensile strength designed for use in personal care absorbent products, and formed by treating cellulosic-based fibers with a polymeric binder and with a chemical stiffening agent, comprising:

saturating cellulosic-based fibers with an aqueous dispersion of a self-crosslinking polymeric binder having a glass transition temperature ranging from −20 and +40° C., an aqueous dispersion of a chemical stiffening agent to form an add-on layer of 10 to 30% by weight, based on the total weight of the fibers, wherein the add-on layer comprises 50 to 95 wt % polymeric binder, and 5 to 50 wt % chemical stiffening agent, based on the total weight of binder and chemical stiffening agent, and heating the saturated cellulosic-based fibers to a temperature which enables binding and crosslinking.

13. The process of claim 12 wherein the polymeric binder and the chemical stiffening agent are applied as a single aqueous dispersion.

14. The process of claim 13 wherein the polymeric binder is a self-crosslinkable vinyl acetate-ethylene emulsion polymer having from 1–4% N-methylol acrylamide polymerized therein and having a Tg from −15 to 10° C.

15. The process of claim 14 wherein the chemical stiffening agent is selected from the group consisting of citric acid, 1,2,3,4-butanetetracarboxylic acid, 1,2,3-propane tricarboxylic acid, 1,2,3,4-cyclopentane tetracarboxylic acid, benzene hexacarboxylic acid and dimethylol dihydroxyethylene urea.

16. The process of claim 14 wherein the chemical stiffening agent is dimethylol dihydroxyethylene urea.

17. The process of claim 12 wherein the chemical stiffening agent is applied to the cellulosic fibers prior to contacting with the polymeric binder, said cellulosic fibers in an unstiffened condition when contacted with the polymeric binder.

* * * * *